United States Patent [19]

Hummel

[11] Patent Number: 4,767,213

[45] Date of Patent: Aug. 30, 1988

[54] OPTICAL INDICATION AND OPERATION MONITORING UNIT FOR VACUUM CLEANERS

[75] Inventor: Karl Hummel, Stuttgart, Fed. Rep. of Germany

[73] Assignee: Interlava AG, Lugano, Switzerland

[21] Appl. No.: 9,741

[22] Filed: Feb. 2, 1987

[30] Foreign Application Priority Data

Feb. 5, 1986 [EP] European Pat. Off. ..... 86 101509.7

[51] Int. Cl.[4] ..... G01N 21/53; A47L 9/19

[52] U.S. Cl. ..... 356/338; 15/339; 250/574; 356/439

[58] Field of Search ..... 356/338, 438, 439; 250/574; 15/319, 339

[56] References Cited

U.S. PATENT DOCUMENTS

| | | | |
|---|---|---|---|
| 4,481,692 | 11/1984 | Kurz | 15/339 |
| 4,580,311 | 4/1986 | Kurz | 15/319 |
| 4,601,082 | 7/1986 | Kurz | 356/438 X |
| 4,680,827 | 7/1987 | Hummel | 356/343 X |

*Primary Examiner*—Davis L. Willis

*Assistant Examiner*—Matthew W. Koren

*Attorney, Agent, or Firm*—McAulay, Fields, Fisher, Goldstein & Nissen

[57] ABSTRACT

In connection with an optical indication and function monitoring unit for vacuum cleaners comprising optical dust detection means in the form of a luminous diode and a phototransistor provided adjacent the suction duct, and optical indication means for the user, it is proposed to provide, in addition to first delay means for the dust detection means, second delay means having a longer time constant and designed in such a manner that a third flashing luminous diode, which also lights up when the supply battery is nearly run down, is triggered when the dust indication does not operate for an extended period. Further, the pressure switch connecting the unit with the supply battery and responding to a vacuum condition generated by the associated vacuum cleaner is adjusted in such a manner that the whole unit is repeatedly connected to the supply battery when a sufficiently high dust level is reached in the dust bag of the vacuum cleaner so that at least one of the luminous diodes provided for the indication seems to flash.

11 Claims, 2 Drawing Sheets

OPTICAL INDICATION AND OPERATION MONITORING UNIT FOR VACUUM CLEANERS

BACKGROUND OF THE INVENTION

The invention starts out from an optical indication and operation monitoring unit according to the preamble of the main claim. In a known device of this type (German Disclosure Document No. 34 31 164), optical dust detecting means, namely a light transmitter in the form of a luminous diode (LED) and a light receiver, for example a phototransistor, are arranged in the suction channel of a vacuum cleaner, which is passed by the dusts, solid particles, or the like drawn in, in such a manner that optical indication lamps are actuated by the interruption, dispersion or reflection of the light beam and by amplification of the electric signal emitted by the photo transistor, the arrangement of the optical indication lamps being such that, for example, a green luminous diode lights up when practically no dust is detected while a red luminous diode lights up when dusts, solid particles, or the like, pass the suction channel. In this manner it is possible to monitor the operation of the vacuum cleaner in a particularly efficient manner because when assessing the degree of cleanliness already reached during the cleaning process the user of the vacuum cleaner is no longer bound to rely on his own personal judgement, but has available an objective indication whether or not a sufficiently high degree of cleanliness has been reached in the area just worked with the vacuum cleaner. The known device uses a delay element connected to the output end of amplifier means for the phototransistor, which delay element is triggered every time dust is detected and which may, for example, consist of a monoflop which remains in its unstable condition for a predetermined period of time, for example two or three seconds, during which time a, for example, red luminous diode lights up to indicate the presence of a corresponding amount of dust. When no further dusts or solid particles are detected by the optical sensors in the suction duct of the vacuum cleaner, then the active time of the monoflop runs out, the green luminous diode lights up, and the user of the vacuum cleaner can proceed to the next area, for example of a carpet. Although this arrangement permits to carry out the cleaning operation with a minimum of energy, cost and time, as it prevents the user from working the areas to be cleaned unnecessarily long, with the resulting excessive degree of wear, it is a problem in connection with the current supply of such an appliance, which in the case of a cylinder vacuum cleaner would have to be effected through the connection hose, that the optical means may get blocked, for example, by very fine dust particles in the suction duct and indicate a degree of cleanliness which actually has not been reached yet. For, when no dust is detected by the optical means, this may have two causes: either there may actually be no dust in the suction channel, or the active surfaces of the luminous diode and/or the phototransistor may have been blocked.

On principle, it has been known to evaluate the amount of dusts detected in the suction pipe of a vacuum cleaner by optical means, namely a photoelectric cell and a light source, for regulating the operation of a vacuum cleaner (German Disclosure Document No. 23 36 758). But except for the information that a light effect detected by a photoelectric cell through dispersion in the suction duct imparts a corresponding signal to suitable control means which then regulates the motor speed of the vacuum cleaner, no other indications can be derived from the cited publication, in particular as regards the practical operation and evaluation of the signals obtained.

Now, it is the object of the present invention to provide an optical indication and function monitoring unit for a vacuum cleaner which can be fitted, maybe even retrofitted, in or on any vacuum cleaner independently and separately and which, in addition to the two basic dust-indication functions, is capable of monitoring and indicating, with a minimum of input, quite a number of additional functions of the vacuum cleaner without the need to switch such an indication and function monitoring unit on manually.

ADVANTAGES OF THE INVENTION

The invention achieves this object with the aid of the characterizing features of the main claim and provides the advantage that an optical indication and function monitoring unit, which preferably may be designed as a self-enclosed block, can be arranged in a clearly visible place in the suction area of the vacuum cleaner, without the need to connect it to the mains current supply, and that this unit operates automatically as regards all its indication and monitoring functions and is in a position to perform a variety of functions. To perform all these indication and function control tasks, the solution according to the invention requires only two external sensors, namely the optical sensor group for detecting the amount of dust present in the area of the suction pipe of the vacuum cleaner, and a mechanical pressure switch. For the indicating functions, three different indication lamps are required whose functions and operation can be evaluated by any user already after a very short adaptation period.

Considering that the unit according to the invention may be designed, preferably, as a one-piece attachment or accessory with integrated current supply through a battery preferably, but also through current supply lines from the main body, for arrangement in the area of the suction duct of a vacuum cleaner, for which purpose it may, for example, be equipped on both sides with correspondingly sized connection pipes, the unit may remain constantly mounted on the vacuum cleaner. In this case, the following advantages are obtained:

(1) The function monitoring unit according to the invention is switched on automatically by the pressure switch only when the associated vacuum cleaner has actually started to operate, i.e. when a corresponding vacuum is built up in the suction area. Similarly, the unit is switched off when the vacuum cleaner stops generating a vacuum.

(2) In the switched-on condition, at least one of two luminous means, i.e. luminous diodes, associated with the dust detection function is always lighting in a manner clearly visible for the user.

(3) When dusts or solid particles are detected in the suction area immediately following the switching-on of the unit, i.e. immediately following the activation of the pressure switch, a red luminous diode (dust LED) will light up first and continue to light as long as dusts are detected by the optical sensor means.

(4) When no dusts are detected any more, the optical indication for the presence of dust switches over, at the end of a pre-determined short delay, for example to a green indicating lamp (green "good" LED) until the presence of fresh dust is indicated by retriggering, for example after the user has been induced by the green indication to move the brush of the vacuum cleaner to a different place.

(5) When no dust has been detected for some period of time, the system switches over to an additional, preferably red indication lamp (flashing LED). This indication can be interpreted in two different ways: either the user has failed to move the brush of the vacuum cleaner to a different place, in which case this indication serves to draw his attention to this fact, or the active surfaces of the optical detection means, i.e. the luminous diode in the suction duct and the photo receiver, have become blocked by dusts, in particular during operation in wet surroundings, and thus rendered incapable of "seeing" the existing dust, in which case the activation of the flashing LED serves to draw the user's attention to the fact that such active surfaces must be cleaned by wiping them shortly, for example with his fingers.

(6) Further, the function monitoring unit according to the invention is capable of supplying an indication when the dust bag is full. To this end, the pressure switch which also serves to switch on the unit, i.e. which connects the unit with the supply battery, is adjusted and designed in such a manner, giving due consideration to the pressure conditions prevailing in the suction pipe, that it opens and closes repeatedly when the vacuum drops below a pre-determined vacuum value which is automatically obtained as the dust bag is getting filled; and since the reciprocating movement of the brush of the vacuum cleaner causes a certain fluctuation of the vacuum value about a mean value which drops gradually, the first red luminous diode ("dust" LED) which indicates the active condition of the unit, finally starts flashing in an irregular rhythm which is, however, normally adapted to the reciprocating movement of the brush of the vacuum cleaner. This is a clearly visible indication for the user that the dust bag has to be changed.

(7) Finally, the function monitoring unit according to the invention is capable of detecting the run-down condition of the battery due to the fact that the optical detection means get less sensitive altogether when the battery runs down so that on the one hand the time-delay means which switch on the flashing LED when the optical dust detecting means are not activated (for some reason or other) run out. Since, on the other hand, the supply voltage arriving from the supply battery has already dropped to a comparatively low value, the flashing LED is no longer supplied with the higher voltage required to effect efficient flashing so that in this case the flashing LED does not flash, but lights only — a clear indication that the battery is run down.

All these functions are performed by the optical indication and function monitoring unit according to the invention with a minimum of installations and equipment; they can be accommodated on very limited space and implemented by as little as three optical indication lamps.

Investigations have shown that the service life of the supply battery, which is switched on and off independently of the user's will, can be estimated at two to three years if corresponding circuit components with low current consumption, including low-voltage diodes for the luminous indication, are used.

The features of the sub-claims define advantageous improvements and developments of the function monitoring unit according to the invention; for example, the unit may without any problems be arranged also in the area of the brush of the vacuum cleaner, as given the comparatively very low cost, every brush may be equipped with a corresponding function monitoring unit to provide the user of the vacuum cleaner, through three different indication lamps, with comprehensive information regarding the operating conditions existing from time to time, including the amount of dust present. On the other hand it is, however, also possible in the case of vacuum cleaners which are already in use to provide a simple intermediate piece, for example an intermediate pipe comprising the function monitoring unit which can be fitted between two lengths of the suction pipe of the vacuum cleaner for providing the user with the corresponding instructions and information through three external indication lamps. Due to the fact that the circuitry of the unit can be accommodated on extremely limited space, the area exceeding the dimensions of the intermediate pipe and accommodating the luminous indications is only little larger than the space necessary for accommodating the supply battery and the mechanical pressure switch.

BRIEF DESCRIPTION OF THE DRAWINGS

Certain embodiments of the invention will be described hereafter with reference to the drawing in which.

DESCRIPTION OF THE PREFERRED EMBODIMENTS

Figure 1:
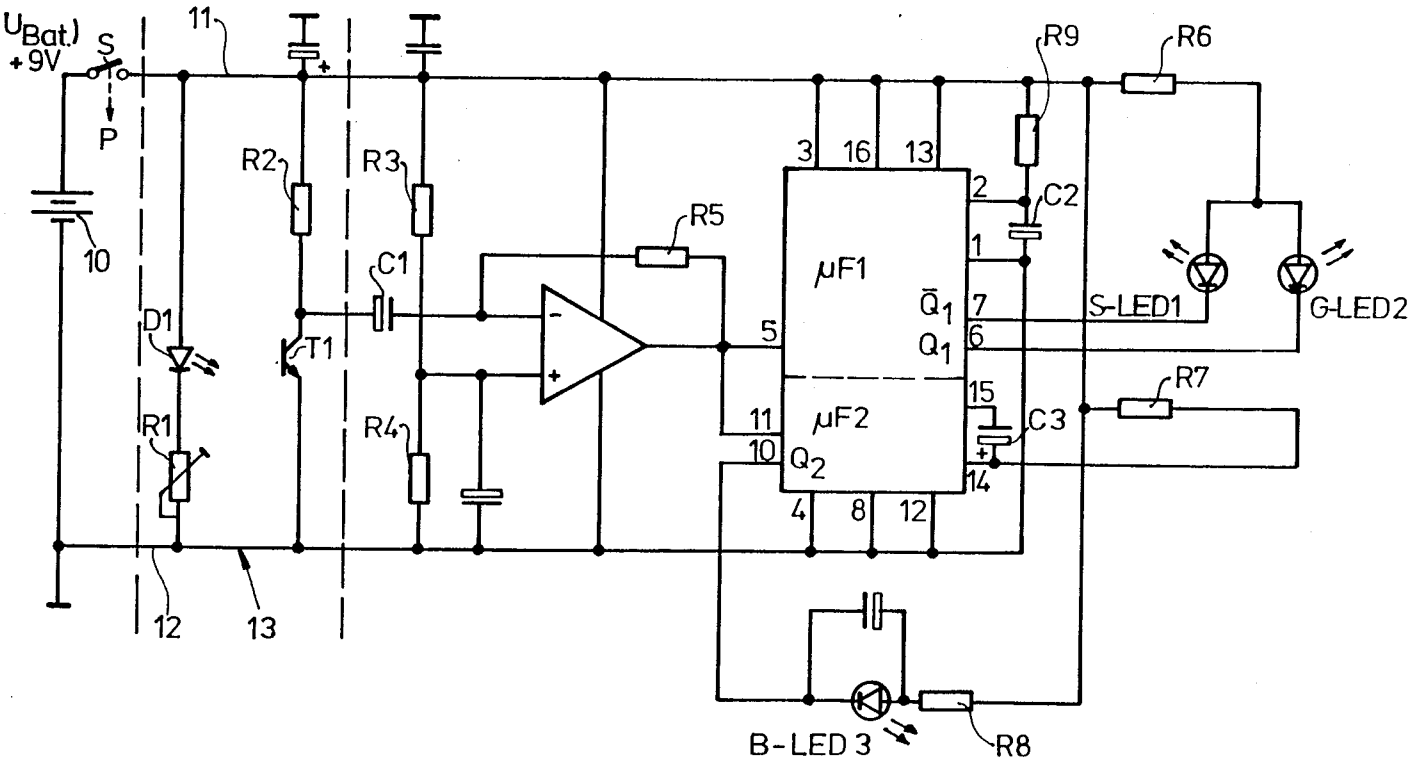
FIG. 1 shows the details of one embodiment of an electric circuit suited for implementing the optical indication and function monitoring unit according to the invention.

Referring to the electric circuit of the function monitoring unit shown in FIG. 1, reference numeral 10 designates the supply battery which is, preferably, a commercially available 9 V block container battery of long service life and which is connected to the positive supply line 11 via the pressure switch S. Alternatively, current supply may be effected from the main body of the vacuum cleaner by using feed lines and the pressure sensitive switch for switching the device on and off. The latter, which will be described in closer detail with reference to FIG. 3, can be adjusted very precisely and is, therefore, capable of switching the function monitoring unit on safely when a corresponding vacuum exists — which in the case of a normal vacuum cleaner, for example a cylinder vacuum cleaner with suction pipe and empty dust bag may reach a value of approximately p =approx. 50 mbar — and of switching it off again when the user stops operating the vacuum cleaner.

Referring again to the drawing, the zone comprising the on/off switch in the form of the pressure switch S and the supply battery is followed by the zone 13 of the optical dust detection means, comprising preferably a luminous diode D1 and a phototransistor T1 acting as a light receiver. The light emitted by the luminous diode D1 is either reflected by the dirt particles, dusts, or the like, and received by the phototransistor as stray light, or the dusts interrupt the direct path of the light beam in the suction duct of the vacuum cleaner so that again a corresponding reaction of the phototransistor T1 is provoked. The luminous diode D1 is connected in series with an adjustable resistor R1; similarly, the phototransistor T1 is connected to supply voltage via a resistor R2. Its signal output is coupled via an intermediate capacitor C1 to the inverted input of a subsequent operational amplifier whose other input is supplied with a threshold value — which may be adjustable, if desired — via two resistors R3 and R4 connected in series. This part of the evaluation and indication system for the amount of dust present has been described sufficiently and extensively by the before-mentioned German Disclosure Document No. 34 31 164 so that it would seem superfluous to give another detailed description here. In any case, the signal of the photo transistor T1, which responds to the presence of dust in the suction duct of the vacuum cleaner, is shaped into pulses, amplified and then supplied to the trigger input 5 of a first monoflop MF1 which is thereby caused to assume its instable condition. The monoflop MF 1 can be wired up from the outside and is provided at its connections 1 and 2 with an RC element comprising a capacitor C2 and a resistor R9 so that its holding time can be adjusted. In the triggered condition, the output Q1 of the monoflop MF1 is connected, for example, to low so that a dust diode S-LED1 indicating the presence of dust, solid particles, or the like, lights up for example in red.

When the area to be worked by the vacuum cleaner has been worked sufficiently until no dust is left, then the quantities of dust and solid particles detected by the dust sensors D1 and T1 are no longer sufficient to permit (repeated) triggering of the monoflop MF1 through the operational amplifiers OP. The monoflop MF1 then returns to its normal condition, its output Q1 drops and the — preferably green — "good" luminous diode G-LED2 lights up. This is a valuable indication for the user that no dust is left in the area being worked and that he can proceed to the next area to be worked. This should suffice as regards the basic function of the unit, i.e. the detection and indication of dust through the diodes S-LED 1 and G-LED2.

For monitoring the dust detection function, the monoflop MF1 has associated to it a second time-delay element in the form of a second monoflop MF2 whose monostable holding time can be determined by an externally connected element comprising the resistor R7 and the capacitor C3. The monoflop MF2, too, is triggered by the output signal of the operational amplifier OP at its input 11, though it can also be triggered by the output of the monoflop MF1. The holding time of the second monoflop MF2 is many times longer than that of the first monoflop. To express it in figures, the first monoflop may, for example, have a delay time of approximately one to two seconds at the end of which the system switches over to the "good" luminous diode G-LED2 if no dust is detected any more by the optical sensors. In contrast, the delay time of the second monoflop MF2 is approximately 30 seconds to 1 minute, it being understood, however, that these figures are not to be interpreted as limiting the invention.

This results in the essential additional function of the monitoring unit according to the invention that when the "good" indication lights continuously, i.e. when no trigger signals are generated because no dust is present, it has to be concluded that either the vacuum cleaner, inspite of being switched on, is no longer moved — a condition, which the user would know himself — or that some trouble is encountered in the function of the optical sensors and/or any of the elements following it. This condition will occur very rarely and only in cases where those surfaces of the luminous diode and/or the phototransistor which are directed into the suction duct are blocked, for example, by wet dust when working for instance under wet conditions. In this case, i.e. when no further trigger signals are received, the monoflop MF2 will, at the end of its holding time, connect another luminous diode, i.e. a so-called flashing luminous diode B-LED3, to supply voltage, via its output Q2, so that this latter luminous diode — which is suitably selected for this purpose — starts flashing at normal supply voltage. This instructs the user that he should clean the light-sensitive surfaces of the optical sensors by wiping them slightly with a suitable cleaning agent or simply with his fingers.

The conditions described above result in still another monitoring function, namely that the run-down condition of the battery can be detected with great safety. When the voltage of the battery gradually drops below the required value, the optical sensors get more and more insensitive so that again no trigger pulses are emitted and the second monoflop MF2 runs out. Depending on the residual charge of the battery 10, either the flashing luminous diode B-LED3 will start flashing again or — when the voltage is already very low — will light constantly and indicate to the user in this manner that the battery has to be changed. Flashing luminous diodes of this type are commercially available and capable of operating at a pre-determined flashing frequency as long as the supply voltage is sufficient. When the supply voltage drops, the flashing frequency drops, too, or the diode starts lighting without flashing.

The elements in the area of the first delay element, i.e. the monoflop MF1, has been selected to ensure that when the unit is switched on by the vacuum switch S, the (red) dust diode S-LED1 will light initially for the period of the holding time of this monoflop. Of course, this diode will then continue lighting as long as further trigger pulses indicating the presence of dust are received.

An additional monitoring function of the present invention consists in making use of the switching behavior of the vacuum switch S, which connects the multifunction unit according to the present invention to the supply voltage of the battery 10, to provide a safe indication of the dust level in the dust bag.

This dust level indication results from a combination of different features, namely that the vacuum switch S is initially capable of switching on the unit by detecting a specific operating condition of the vacuum cleaner, namely the presence of a vacuum, and the fact that this vacuum does not remain constant, but diminishes from initially high values (in this context, high is only relative; actually, the fluctuation range of the vacuum generated is only in the area of approximately 15 to 50 mbar so that the vacuum switch itself must be very sensitive and, above all, precisely adjustable) when the dust bag is empty to correspondingly lower values, while on the other hand additional fluctuations of the vacuum, in the range of, say, ±5 mbar, are caused by the reciprocating movement of the brush of the vacuum cleaner relative to the material to be worked.

It is, therefore, a secondary feature of the present invention that the vacuum switch S is adjusted in such a manner that it will be actuated, for example by a switching operation, when the vacuum acting on the switch and/or on its diaphragm exceeds a value of, say, 15 mbar — to state a numerical figure for the sake of clarity. As the level of dust in the dust bag then increases gradually, the air velocity generated by the blower of the vacuum cleaner diminishes so that the vacuum drops, too, until it finally gets into a range where the pressure rises and drops alternately above and below the response value pre-set on the vacuum switch, initially only intermittently and then more and more frequently, at least when the brush is moved to and fro on the carpet. The vacuum switch then opens, the whole unit is disconnected from its voltage supply, and all indication diodes extinguish, and when the vacuum switch closes again, the (red) dust diode S-LED1 starts lighting again. To say it in other words: the dust diode S-LED1 starts flashing when the dust level in the dust bag approaches an unadmissible value.

Figure 2:
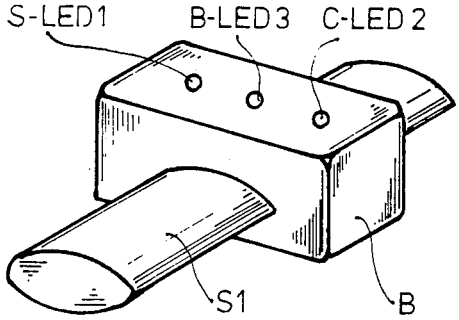
FIG. 2 is a perspective view of one possible embodiment of the function monitoring unit according to the invention in the form of a self-enclosed block to be fitted as an intermediate piece.

The whole optical indication and function monitoring unit for a vacuum cleaner according to the invention can be accommodated without any problems on very limited space, it being only required that this space be located adjacent an area where the vacuum of the vacuum cleaner can be picked up and the optical dust sensors can be arranged in such a manner that they respond to the dust particles passing the suction duct. This can be achieved in the simplest of all cases by the solution illustrated by the diagrammatic representation of FIG. 2 which shows, in exaggerated scale, a block B which contains the circuit elements, the battery and the vacuum switch and which is provided on both sides with connection pipes S1, S2 for being fitted for example between the hose and the handle of a cylinder vacuum cleaner or between the rigid pipe and the brush of such a vacuum cleaner, simply by fitting the two short pipe ends S1 and S2 upon the matching adjacent parts of the suction duct. As mentioned before, such a function monitoring unit will then be switched on automatically when the vacuum cleaner is put into operation, and be in a position to provide the user with information on practically all essential functions of the vacuum cleaner, by means of the three different and, preferably, differently colored luminous diodes.

It is of course also possible, as mentioned before, to arrange such a multi-function indication and monitoring unit directly in the different brushes of the vacuum cleaner, on the body of the vacuum cleaner itself, or also in hose inserts, in the handle area, or the like. In all these cases, no line connections to the vacuum cleaner and its main supply have to be realized and the multiple indication functions described before are obtained in most cases through the described multiple utilization of the electric and mechanical circuit components employed.

Hereafter, a preferred embodiment of a highly sensitive pressure switch S that can be adjusted with high precision will be described in detail with reference to the representation of FIG. 3.

Figure 3:
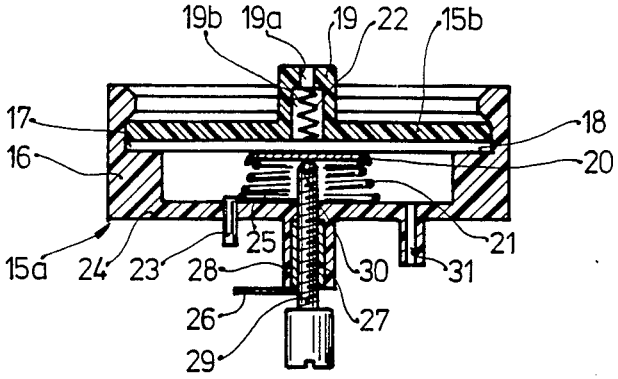
FIG. 3 shows a preferred embodiment of the multifunction pressure switch for switching on and off the function monitoring unit and for indicating the filling level of the dust bag, with means for the precise adjustment of the pressure threshold.

The highly sensitive vacuum diaphragm switch shown in FIG. 3 comprises a pot-shaped first casing part 15*a* and a cover 15*b*. The annular raised wall area 16 of the pot-shaped casing part is provided with an inner annular groove 17 in which both the very thin, extremely resilient and slack diaphragm 18 is fixed by its marginal area, and the disk-shaped cover 15*b*, which is provided with a central first connection pipe 19 provided with a — preferably — stepped passage 19*a* leading to one side of the diaphragm 18, is held by means of a projecting shoulder. The dimensions of the cover 15*b* of the annular groove holding and fixing the latter are selected in such a manner that the cover 15*b* can be snapped in by force after the diaphragm 18 has been introduced into the annular groove 17, whereby both the cover and the marginal area of the diaphragm 18 are fixed in position and safely held and retained.

The bottom of the diaphragm 18 — as viewed in the drawing — is in contact with a contact plate 20 which may also be fixed to the diaphragm by gluing, or the like. A biasing spring 21 bearing upon this contact plate urges the diaphragm upwardly, it being also possible to provide an additional spring 22 in an enlarged part of the bore 19*b* in the connection pipe 19 of the cover in order to bring the diaphragm into a defined initial position. The spring 21 acts at the same time as the electric conductor leading to the first contact connection 23 which may take the form of a contact pin 23 recessed or inserted into the bottom 24 of the pot-shaped casing part 15*a*. The contact pin contacts at 25 the biasing spring 21 which is electrically connected to the contact plate 20 and forms in this manner a first connection, for example a soldered pin, for the electric switch formed in this manner.

The other pole is formed by a soldering lug 26 which may be provided on or formed integrally with a metallic bushing 27 inserted into a pipe connection 28 which projects downwardly from the bottom of the casing and may, preferably, be formed integrally from a suitable plastic material. The bushing 27 is provided with an internal thread and encloses a screwed pin 29 which, while sealing the thread area perfectly, passes through the bottom of the casing and has its contact pin 30 arranged at a distance from the contact plate 20 which is driven by the diaphragm 18. In addition, a connection pipe for supplying pressure or differential pressure is indicated at 38 in the bottom of the casing. The threaded pin 29 permits the active working distance between the contact plate 20 and the contact pin 30 to be adjusted and pre-adjusted with high precision so that a diaphragm switch of this type is capable of reacting with extreme sensitivity and accuracy to even very low pressure effects, i.e. to overpressure, vacuum effects or differential pressures, depending on the connections, 19 or 31, where the pneumatic functions to be monitored come to act.

All features mentioned or shown in the above description, the following claims and the drawing may be essential to the invention either alone or in any combination thereof.

I claim:

1. An optical indication and function monitoring unit for a vacuum cleaner of the type having a suction duct through which dust particles pass to a dust bag, comprising a housing adapted to be connected with the suction duct, optical dust detection means in said housing positioned to be traversed by the dust particles, a plurality of different indication lamps in said housing, amplifier means connecting said plurality of lamps to the output end of said dust detection means, a vacuum switch in said housing responsive to the value of the vacuum in the suction duct for connecting said unit to a source of power, said vacuum switch including adjustment means for adjusting said switch to disconnect the source of power from said unit when the suction falls to a preselected value corresponding to a predetermined level of dust in the dust bag, at least one of said plurality of indication lamps being connected in circuit with said switch to be illuminated thereby when said switch is operated to connect said unit to the power source.

2. An optical indication and function monitoring unit for vacuum cleaners according to claim 1, in which said dust detection means includes a first delay means having alternate output terminals connected to at least first and second ones of said plurality of indication lamps, and second delay means having a greater delay time than said first delay means, and a third one of said plurality of indication lamps connected to the output of said second delay means, said first delay means being operable to energize said first indication lamp when said detection means detects dust in the suction dust and to energize said second indication lamp after a first time period has elapsed after the absence of dust particles in the suction duct.

3. An optical indication and function monitoring unit as in claim 2, wherein said first delay means comprises a monoflop having a stable and an unstable state, said monoflop being operated to the unstable state when said vacuum switch operates to connect said unit to a source of power, said dust detection means being operable to drive said monoflop to said unstable state upon the detection of dust in said suction duct, said first indication lamp being connected to said monoflop to be illuminated thereby when said monoflop is in said unstable state, said second indication lamp being connected to said monoflop to be illuminated thereby when said monoflop is in said stable state.

4. An optical indication and function monitoring unit according to claim 3, wherein said first indication lamp flashes on and off in response to the corresponding operation of said switch means.

5. An optical indication and function monitoring unit according to claim 2, in which said second delay means is responsive to a power source voltage above a preselected level, said second delay means being operable to energize said third indication lamp when said battery voltage falls below said preselected level.

6. An optical indication and function monitoring unit as in claim 5, wherein said third indication lamp comprises a flashing luminous diode, said flashing luminous diode comprising means for illuminating continuously in response to a low voltage condition.

7. An optical indication and function monitoring unit as in claim 1, wherein said housing is provided with connection pipes provided on each end adapted to connect between corresponding pipes or hose ends of the suction duct.

8. An optical indication and function monitoring unit as in claim 1, wherein the vacuum switch is mounted in said housing to sense the vacuum therein, and said optical dust detection means is mounted in said housing to detect the presence of dust entering the suction duct.

9. An optical indication and function monitoring unit according to claim 1, wherein said housing includes means for connecting said housing to the vacuum cleaner adjacent the suction area thereof.

10. An optical indication and function monitoring unit as in claim 1, wherein the power source comprises a battery in said housing.

11. An optical indication and function monitoring unit as in claim 1, and in which said vacuum cleaner includes a brush attachment, said housing being formed as part of said brush attachment.

* * * * *